United States Patent [19]

Murrell

[11] 4,237,633

[45] Dec. 9, 1980

[54] PHOTOGRAPHIC MAILING POSTCARD AND BLANK THEREFOR

[76] Inventor: Robert T. Murrell, 1023 Euclid Ave., Marion, Ind. 46952

[21] Appl. No.: 163

[22] Filed: Jan. 2, 1979

[51] Int. Cl.[3] ..... B42D 15/04

[52] U.S. Cl. ..... 40/158 R; 229/92.8

[58] Field of Search ..... 40/158 R, 159, 158 B, 40/152.1, 152, 124.1; 229/92.8, 92.3

[56] References Cited

U.S. PATENT DOCUMENTS

| | | | |
|---|---|---|---|
| 1,261,133 | 4/1918 | Kidd | 40/158 R |
| 1,593,301 | 7/1926 | Havemeyer | 40/158 R X |
| 2,817,171 | 12/1957 | Das | 40/158 R |
| 3,024,553 | 3/1962 | Rowley | 40/158 R |
| 3,174,244 | 3/1965 | Walton | 40/158 R |
| 3,304,641 | 2/1967 | Gonczy | 40/158 R |
| 3,341,961 | 9/1967 | Shanks | 40/158 R |
| 3,847,325 | 11/1974 | Nasalski et al. | 229/92.8 |
| 4,008,852 | 2/1977 | Davis | 229/92.8 |
| 4,167,241 | 9/1979 | Zumbrunn | 40/152.1 X |

*Primary Examiner*—John F. Pitrelli

*Attorney, Agent, or Firm*—Albert L. Jeffers; Robert G. Irish

[57] ABSTRACT

A photograph mailing postcard comprises a unitary rectangular card of paper material having top and bottom longitudinal edges, and opposite side edges, and front and back sides. The card has top and bottom sections respectively defined by a first line which extends between the side edges and parallel with the longitudinal edges. A cut is formed in the card along the first line from one side edge to a point spaced from the other side edge thus forming top and bottom connection portions of the sections defined by the other side edge, the longitudinal edges and a second line which extends between the longitudinal edges through the point on the first line and parallel with the other side edge, and top and bottom flap portions respectively joined to the connected portions along the second line. The bottom flap portion has a rectangular window therein covered by a sheet of transparent material adhered to the front side. Serrations are provided in the bottom flap portion which form three selectively removable rectangular segments respectively bounding three sides of the window. The two sections are folded along the first line with the front sides of the connected portions abutting and adhered together. Adhesive strip is provided on the front side of the top flap portion for attaching a photograph for viewing through the window in the bottom flap. The top section is scored along the second line to permit folding the top flap portion to facilitate attaching the photograph thereto. The front side of the top flap portion has indicia thereon respectively outlining attachable locations for photographs of different sizes. Adhesive is also provided on the front side of one of the flap portions for adhering the two flap portions together following attachment of the photograph.

13 Claims, 4 Drawing Figures

18
78
36
44
74
76
14
86
68
70
72
82
64
66
Remove cover from adhesive and press photo down in proper square.
1. Small photo - Square 1. All flaps intact.
2. Poloroid SX70-Square 2. Remove top flap.
3. Kodak Instant-Square 3. Remove right flap.
4. 3 1/2 X 4 1/2 - Square 4. Remove both right and bottom flaps.
34
26
32
80
16
52
58
54
40
60
84
48
62
56
50
38
46
20

PHOTOGRAPHIC MAILING POSTCARD AND BLANK THEREFOR

BACKGROUND OF THE INVENTION

1. Field of the Invention

This invention relates generally to photograph mailing postcards, and more particularly to a photograph mailing postcard which protects the photograph and will accommodate photographs of different sizes.

2. Description of the Prior Art

A number of photograph mailing postcards have been proposed, such as those disclosed in U.S. Pat. Nos. 4,008,852; 3,847,325 and 3,304,641. However, to the best of the present applicant's knowledge, such prior photograph mailing postcards either do not accommodate photographs of different sizes, or did not provide protection for the photograph during mailing. Furthermore, such prior photograph mailing postcards did not lend themselves to merchandising display in a rack.

It is therefore desirable to provide a photograph mailing postcard which will accommodate photographs of different sizes, protects the photograph during mailing, and is readily displayed in a merchandising rack.

SUMMARY OF THE INVENTION

In its broader aspects, the invention provides a photographic mailing postcard comprising a unitary rectangular card of paper material having top and bottom longitudinal edges and opposite side edges, and front and back sides. The card has top and bottom sections respectively defined by a first line extending between the side edges and parallel with the longitudinal edges. The card has a cut along the first line from one side edge to a point spaced from the other side edge thereby forming top and bottom connected portions of the top and bottom sections defined by the other side edge, the longitudinal edges and a second line extending between the longitudinal edges through the point on the first line parallel with the other side edge, and top and bottom flap portions respectively joined to the connected portions along the second line. The bottom flap portion has a window formed therein, and the sections are folded along the first line with the front sides of the connected portions abutting and adhered together. Means are provided for attaching a photograph to the front side of the top flap portion for viewing through the window. At least one of the flap portions is adapted to be folded along the second line so as to facilitate attaching the photograph to the front side of the top flap portion, and means are provided on the front side of at least one of the flap portions for adhering the same to the front side of the other flap portion after attachment of the photograph so as to provide a unitary postcard for mailing with the photograph displayed through the window.

The invention also contemplates a blank for forming a photograph mailing postcard as described above.

It is accordingly an object of the invention to provide an improved photograph mailing postcard.

Another object of the invention is to provide a blank for an improved photograph mailing postcard.

A further object of the invention is to provide an improved photograph mailing postcard adapted to accommodate different size photographs and to protect the photograph during mailing.

Yet another object of the invention is to provide an improved photograph mailing postcard which may readily be displayed in a merchandising rack.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
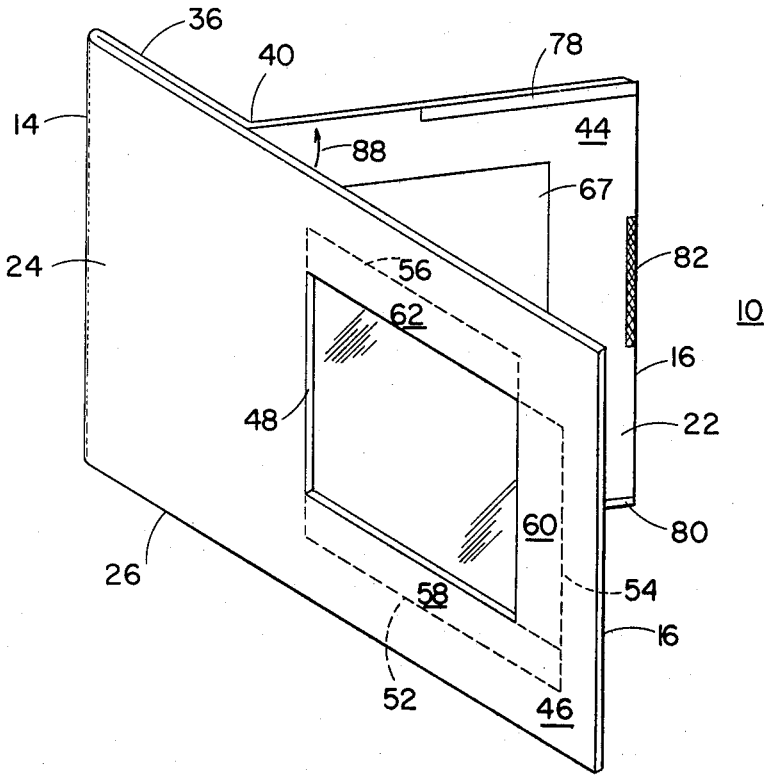
FIG. 1 is a perspective view of the improved photograph mailing postcard of the invention positioned for attaching a photograph thereto.
Figure 2:
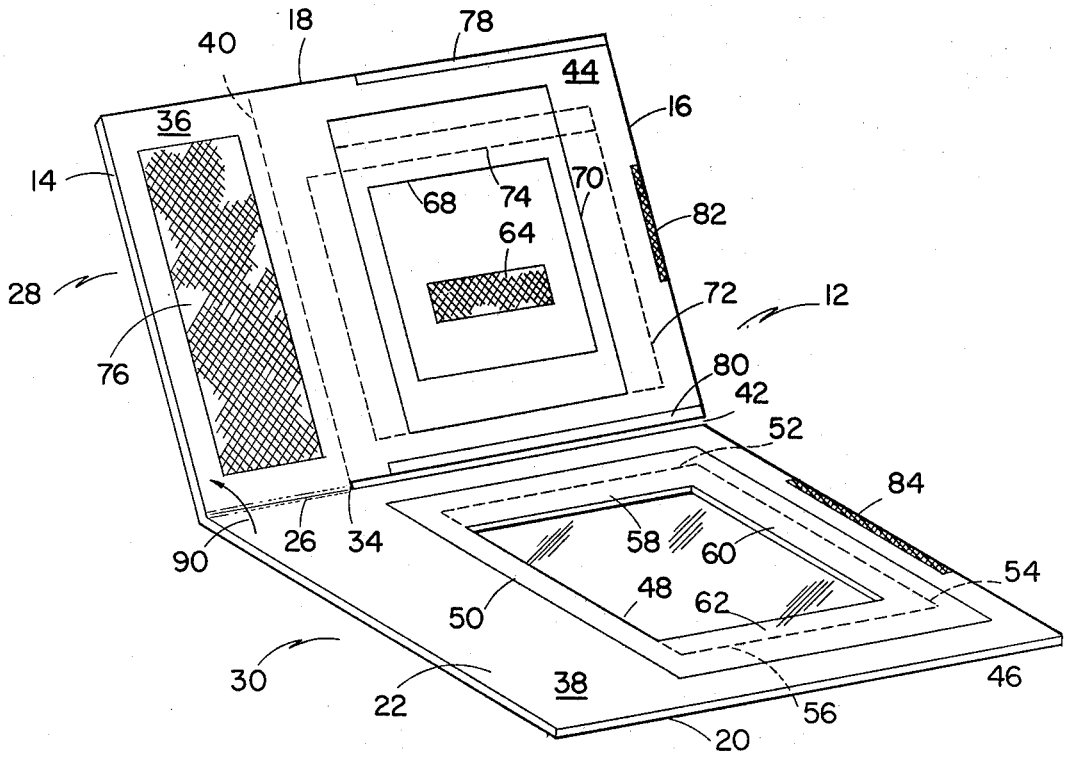
FIG. 2 is a view in perspective of the photograph mailing postcard of the invention during the course of assembly.
Figure 3:
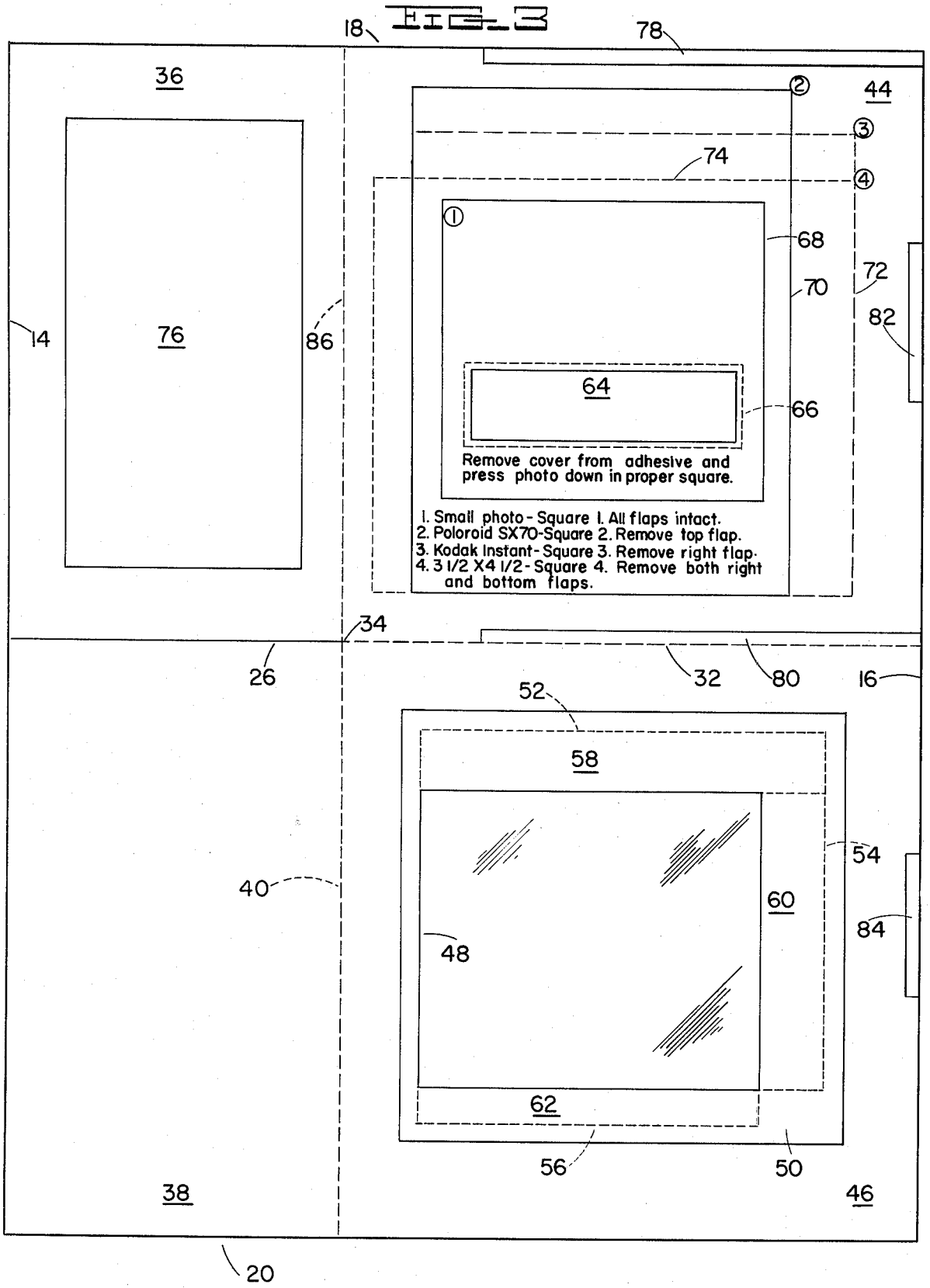
FIG. 3 is a view of the front side of the blank employed in the photograph mailing postcard of the invention.
Figure 4:
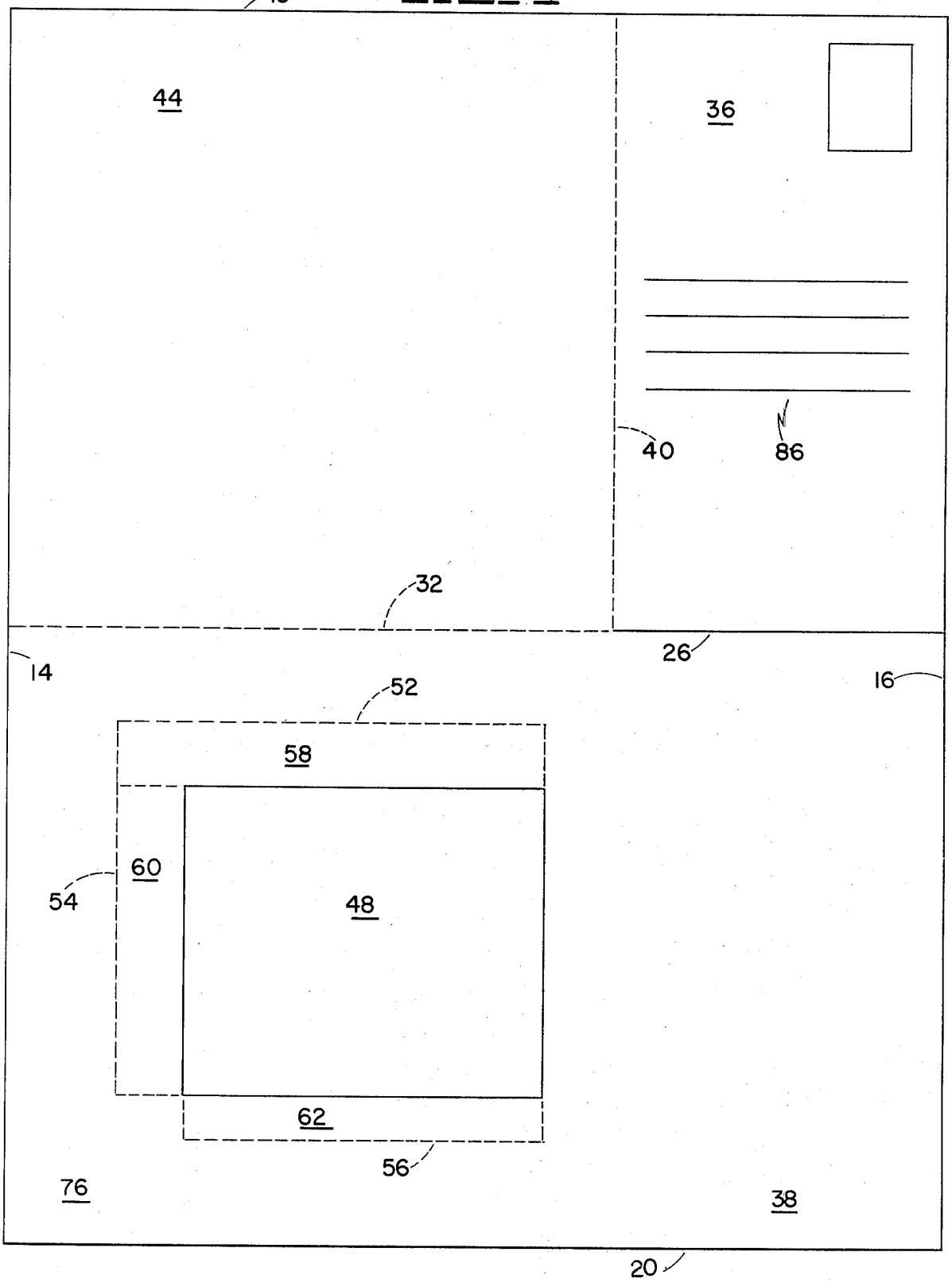
FIG. 4 is a view of the back side of the blank of FIG. 3.

Referring now to the figures of the drawing, the improved photograph mailing postcard of the invention, generally indicated at 10 in FIG. 1, is formed of a unitary, rectangular blank 12 of paper material, such as coated cardboard, having top and bottom longitudinal edges 18, 20, front side 22 as shown in FIGS. 2 and 3, and back side 24, as shown in FIGS. 1 and 4.

Line 26 extending between side edges 14, 16 and parallel with longitudinal edges 18, 20 divides card 12 into top and bottom sections 28, 30 (FIG. 2). Serrations 32 (FIG. 3) extend along line 26 from side edges 16 to point 34 spaced from side edge 14 thus forming top and bottom portions 36, 38 integrally joined along the line 26, top and bottom portions 36, 38 being defined by side edge 14, longitudinal edges 18, 20, and line 40 extending between longitudinal edges 18, 20 through point 34 and parallel with side edges 14, 16. Serrations 32 permit formation of a cut or slit 42 (FIG. 2) along line 26 extending from side edge 16 to point 34 thereby to define top and bottom flap portions 46, 48 respectively integrally joined to connected portions 36, 38 along line 40.

Rectangular window 48 is formed in bottom flap portion 46 and is covered by sheet 50 of suitable transparent material adhered to front side 22. Serrations 52, 54, 56 respectively define rectangular, break-away or removable segments 58, 60, 62 which bound or border three sides of opening 48.

Front side 22 of top flap portion 44 has strip 64 of contact adhesive thereon, initially covered by a protective covering strip of material such as paper, as shown by the dashed lines 66 (FIG. 3). When protective strip 66 is removed, a photograph 67 (FIG. 1) may be attached to front side 22 of top flap portion 44 by means of adhesive strip 64. It will be seen that indicia 68, 70, 72, 74 define rectangles, indicated by the circled numerals 1, 2, 3 and 4 for locating photographs of differenct sizes. Thus, a small $2\frac{1}{2}'' \times 2\frac{1}{2}''$ print is located in square No. 1, a Polaroid SX70 print in square No. 2, a Kodak instant camera print in square No. 3 or a standard $3\frac{1}{2}'' \times 4\frac{1}{2}''$ print in square No. 4. Instructions for so locating prints may be included on front side 22 of top flap portion 44, as shown in FIG. 3. Those instructions may include an indication of the break-away segment or segments to be removed from bottom flap portion 46 in order to provide opening 48 of the proper size for the particular photograph. Thus, with a small 2½"×2½" print located in square No. 1, all of the break-away segments 58, 60 62 are left intact. In the case of a Polaraid SX70 print occupying square No. 2, the top break-away segment 62 is removed, and in the case of a Kodak instant print occupying square No. 3, the side break-away segment 60 is removed. Finally, in the case of a 3½"×4½" print occupying square No. 4, both the side and bottom break-away segments 60, 62 are removed.

Area 76 on front side 22 of top connected portion 30 is coated with suitable adhesive and strips 78, 80 respectively adjacent top longitudinal edge 18 and serration 32 on front side 22 of top flap portion 44 are likewise coated with suitable adhesive, such as of the moistenable type. Strips 82, 84 on front side 22 of top and bottom flap portions 44, 46 adjacent side edge 16 are provided with suitable contact adhesive, or some other adhesive-type material permitting temporary attachment of flaps 44, 46 in abutting relation. Suitable scoring 86 along line 40 from point 32 to top longitudinal edge 18 permits folding top flap portion 44, as shown by arrow 88 in FIG. 1. It will be readily understood that adhesive strips 78, 80 may comprise contact-type adhesive initially covered by protective paper strips.

Top and bottom sections 28, 30 are folded along line 26, as shown by arrow 90 in FIG. 2, so that front sides 22 of top and bottom connected portions 36, 38 are abutting, as shown in FIG. 1. Temporary adhesive or closure strips 82, 84 permit temporarily holding top and bottom flap portions 44, 46 in abutting relation for display of the photograph mailing postcard 10 on a merchandising display rack. In use, top flap portion 44 is folded in the direction shown by the arrow 88 to the position shown in FIG. 1 thereby permitting attachment of a photograph thereon at the appropriate location, and separation of the appropriate break-away segments 58, 60, 62, as above described. Adhesive strips 78, 80 are then moistened and upper flap portion 44 folded about line 40 to abut and adhere to lower flap portion 46, thereby providing a photograph mailing postcard in which the photograph 67 is protected by plastic sheet 50. Back side 24 of top connected portion 36 may have address indicia thereon, as suggested at 86, and an appropriate space for a message is provided on back side 24 of upper flap portion 44, all as shown in FIG. 4.

It will now be seen that the invention provides a photograph mailing postcard wherein the photograph is protected during mailing, and which will accommodate and attractively display photographs of different sizes. It will also be seen that the photograph mailing postcard device of the invention can readily be displayed in mechandising display racks.

While there have been discribed above the principles of this invention in connection with specific apparatus, it is to be clearly understood that this description is made only by way of example and not as a limitation to the scope of the invention.

What is claimed is:

1. A photograph mailing postcard comprising a unitary rectangular card of paper material having top and bottom longitudinal edges and opposite side edges, and front and back sides, said card having top and bottom sections respectively defined between said side edges and parallel with said longitudinal edges, said card having means for partially separating said sections extending along said first line with one side edge to a point spaced from the other side edge thereby forming top and bottom integrally connected portions of said sections defined by said other side edge, said longitudinal edges and a second line extending between said longitudinal edges through said point and parallel with said other side edge, and top and bottom flap portions respectively joined thereto along said second line, said bottom flap portion having a window formed therein, said sections being folded along said first line with said front sides of said connected portions abutting and adhered together, means for attaching a photograph to said front side of said top flap portion for viewing through said window, means for folding at least one of said flap portions along said second line thereby to facilitate attaching said photograph to said front side of said top flap portion, and means on said front side of at least one of said flap portions for adhering the same to said front side of the other flap portion.

2. The postcard of claim 1 wherein said window is rectangular, said bottom flap portion having means formed therein for forming at least one selectively removable rectangular segment bounding one side of said window thereby selectively to enlarge said window.

3. The postcard of claim 2 wherein said last-named means forms three selectively removable rectangular segments respectively bounding three sides of said window.

4. The postcard of claim 2 wherein said front side of said top flap portion has indicia thereon respectively indicating attachment locations for at least two different size photographs.

5. The postcard of claim 4 wherein said adhering means comprises first means adjacent said one side edge of at least said top flap for temporarily adhering said flaps together, and second means adjacent the respective longitudinal edge of said top flap for permanently adhering said flaps together.

6. The postcard of claim 5 further comprising a sheet of transparent material attached to said front side of said bottom flap and covering said window.

7. A blank for forming a photograph mailing postcard comprising a rectangular card of paper material having top and bottom longitudinal edges and opposite side edges, and front and back sides, said card having top and bottom sections respectively defined by a line extending between said side edges and parallel with said longitudinal edges, means extending on said line from one side edge to a point spaced from the other side edge for partially separating said sections thereby to form top and bottom integrally connected portions of said sections defined by said other side edge, said longitudinal edges, and a second line extending between said longitudinal edges through said point and parallel with said other side edge, and top and bottom flap portions respectively joined thereto along said second line, means for folding at least one of said flap portions along said second line, said bottom flap portion having a rectangular window formed therein, and means for selectively removing at least one rectangular segment bounding one side of said window thereby selectively to enlarge said window, said sections being adapted to be folded about said first line into abutting relationship thereby to frame a photograph attached to said top section in said window.

8. The blank of claim 7 wherein said bottom section has means for selectively removing three rectangular segments respectively bounding three sides of said window.

9. The blank of claim 7 wherein said top section has indicia thereon respectively indicating attachment locations for at least two different size photographs.

10. The blank of claim 7 wherein said window is formed in said bottom flap portion.

11. The blank of claim 7 wherein at least one of said top and bottom connected portions has adhesive thereon for adhering said connected portions together, said top flap portion having means thereon for attaching a photograph thereto.

12. The blank of claim 11 further comprising first means on said top flap portion adjacent said one side edge for temporarily adhering said flap portions together, and second means on said top flap portion adjacent said top longitudinal edge for permanently adhering said flaps together.

13. The blank of claim 7 wherein a sheet of transparent material is attached to one side of said card covering said window.

* * * * *